United States Patent [19]

Maryon

[11] Patent Number: 4,736,557

[45] **Date of Patent: * Apr. 12, 1988**

[54] SUPER HIGH-RISE BUILDINGS

[75] Inventor: John G. Maryon, Toronto, Canada

[73] Assignee: Stratatowers Corporation, Toronto, Canada

[ * ] Notice: The portion of the term of this patent subsequent to Apr. 14, 2004 has been disclaimed.

[21] Appl. No.: 34,229

[22] Filed: Apr. 2, 1987

Related U.S. Application Data

[63] Continuation-in-part of Ser. No. 856,461, Apr. 28, 1986, Pat. No. 4,656,799.

[51] Int. Cl.[4] ..... E04H 1/00; E04H 14/00

[52] U.S. Cl. ..... 52/236.3; 52/30; 187/1 R

[58] Field of Search ..... 52/236.3, 30, 234, 236.1, 52/236.4, 745; 187/1 R

[56] References Cited

U.S. PATENT DOCUMENTS

| | | | |
|---|---|---|---|
| 1,967,832 | 7/1934 | Lindquist | 187/1 |
| 3,213,572 | 10/1965 | Hohla | 52/73 |
| 3,226,727 | 12/1965 | Frey | 52/745 |
| 3,239,990 | 3/1966 | Adler | 52/745 |
| 3,260,028 | 7/1966 | Fraser | 52/745 |
| 3,279,142 | 10/1966 | Entwistle | 52/745 |
| 3,395,502 | 8/1968 | Frey | 52/73 |
| 3,396,502 | 8/1968 | Contevita | 52/236 |
| 3,495,371 | 2/1970 | Mitchell | 52/648 |
| 3,659,387 | 5/1972 | Pearson | 52/30 |
| 3,733,763 | 5/1973 | Drucker | 52/126 |
| 3,738,069 | 6/1973 | Navarette-Kindelan | 52/73 |
| 3,791,093 | 2/1974 | Finsterwalder | 52/745 |
| 3,895,473 | 7/1975 | Fraser | 52/745 |
| 3,981,109 | 9/1976 | Termohlen | 52/126 |
| 4,035,973 | 7/1977 | Sutelan | 52/263 |
| 4,071,988 | 2/1978 | Bowes | 52/127 |
| 4,098,039 | 7/1978 | Sutelan | 52/73 |
| 4,345,408 | 8/1982 | Cote | 52/169.3 |
| 4,656,799 | 4/1987 | Maryon | 52/236.3 |

FOREIGN PATENT DOCUMENTS

| | | |
|---|---|---|
| 2065192 | 6/1981 | United Kingdom . |
| 2079810 | 1/1982 | United Kingdom . |

OTHER PUBLICATIONS

Architectural Forum, vol. 94, No. 1, Jan. 1951, pp. 75 et seq.

William J. LeMessurier's Super-Tall Structures: A Search for the Ideal," Architectural Record, Jan. 1985, pp. 145–151.

S. Ashley, "Superskyscrapers; How High Can They Build Them?", Popular Science, Dec. 1985, pp. 63–65, 96, 97.

J. B. Tucker, "Superskyscrapers: Aiming for 200 Stories", High Technology, Jan. 1985, pp. 50–63.

D. Meredith, "Superscrapers; Can We Build Them? Maybe." Republic, Jul. 1985, pp. 22–25.

W. McQuade, "Where's the Architecture?" Connoisseur, pp. 81–82.

*Primary Examiner*—J. Karl Bell

*Attorney, Agent, or Firm*—Robert R. Jackson

[57] ABSTRACT

A very tall but slender multi-use building having at least, and preferably substantially more than, 75 human-occupiable stories (e.g., 75–300 human-occupiable stories). The main structural element of the building is a hollow, vertical prism of reinforced concrete made up of interconnected, substantially planar, vertical walls. Most of the human-occupied floor space is outside the prism. The prism preferably carries substantially the entire load of at least that portion of the building above about the 75th floor.

40 Claims, 14 Drawing Sheets

SUPER HIGH-RISE BUILDINGS

This application is a continuation-in-part of U.S. patent application Ser. No. 856,461, filed Apr. 28, 1986.

BACKGROUND OF THE INVENTION

This invention relates to very tall multi-use structures, i.e., buildings generally in excess of 75 stories, and especially buildings in the range from 75 to 250 or more stories. The buildings of interest in connection with the present invention are only those intended primarily for human occupation, not unoccupied structures such as radio towers.

For a number of years structural engineers have been attempting to devise satisfactory structural systems for buildings substantially taller than the presently tallest skyscrapers of approximately 100 stories. Some of the problems associated with such buildings, and some of the proposed solutions to those problems, are discussed in J. B. Tucker, "Superskyscrapers: Aiming for 200 Stories", *High Technology,* January 1985, and S. Ashley, "Superskyscrapers; How high can they build them?", *Popular Science,* December 1985. As these articles point out, all of these proposed buildings have various shortcomings. One very severe problem, which is shared by many of these proposed buildings, is that the structural techniques employed to impart strength and stiffness to the structure are both very expensive and largely useless for any purpose other than imparting such strength and stiffness.

It is therefore an object of this invention to improve and simplify the design and construction of very tall buildings.

It is another object of this invention to reduce the cost of very tall buildings by employing for the main structural members materials which are relatively inexpensive, which can be erected relatively inexpensively, which are employed in a structurally efficient and effective manner, and which additionally serve purposes other than merely imparting strength and stiffness to the structure.

SUMMARY OF THE INVENTION

These and other objects of the invention are accomplished in accordance with the principles of the invention by providing a building having generally at least 75 stories (preferably at least 100 stories), the main structural element of which is a vertically-oriented, hollow, substantially prismatic member of reinforced concrete, for convenience referred to herein as the "prism". Each main side of the prism is essentially a continuous, substantially planar wall. These walls are connected to one another at their adjacent vertical edges by integral corner piers. These corner piers brace the main walls relative to each other and transmit forces between the walls.

The prism (including both the main walls and the corner piers) is the main structural member of the building and provides the vast majority of the necessary space partitioning required in the building's core. Most of the human-occupiable floor space is outside the prism, so that the prism forms the interior wall of this exterior floor space. For buildings substantially taller than about 75 stories, all support for the portion of the structure above about the 75th storey is preferably provided by the prism. Thus, all exterior floor space above about this level is preferably cantilevered from the prism.

For the most part, the prism forms (in plan) a continuous annulus of reinforced concrete. At substantially all horizontal levels this annulus has at most only a relatively small number of apertures such as are required to permit human movement between the inside and outside of the prism. These apertures comprise a relatively small fraction of any horizontal circumference of the prism, i.e., less than about 25% of any such horizontal circumference.

All the elevators, stairs, and mechanical and service rooms are positioned inside the prism. At each corner thereof, inside the corner pier, a stair is housed, bounded by a secondary wall which intersects both the main prism walls at locations remote from the vertical edges of these walls. This secondary wall, which braces the main prism walls, spans between same and hence carries the stair load back to the main prism walls. Similar secondary walls house the elevator runways and intersect the main walls of the prism at points more distant from the corner piers. Again, these secondary walls transmit all elevator and other loading inside the prism to the main walls of the prism.

Floors interior to the prism are optional and may be provided for the most part only where elevator landings or floor space for mechanical equipment or the like is required. Any such interior floors communicate with horizontally adjacent exterior floors via apertures in the prism.

In the particularly preferred embodiment, the prism is, in plan view, a substantially hollow, approximately equilateral triangle. All loads interior to this triangle are automatically transferred to the main prism walls. Equally, all floor space above about the 75th floor is cantilevered from the main prism walls and the corner piers. Due to the vast inherent strength of the main prism walls, all this loading can be automatically transferred to the corner piers to resist lateral force from wind or earthquake. The triangular juxtaposition of the three corner piers provides the vast strength, stiffness, and stability which are among the main attributes of the invention.

Further features of the invention, its nature and various advantages will be more apparent from the accompanying drawings and the following detailed description of the invention.

DETAILED DESCRIPTION OF THE PREFERRED EMBODIMENTS

Figure 1:
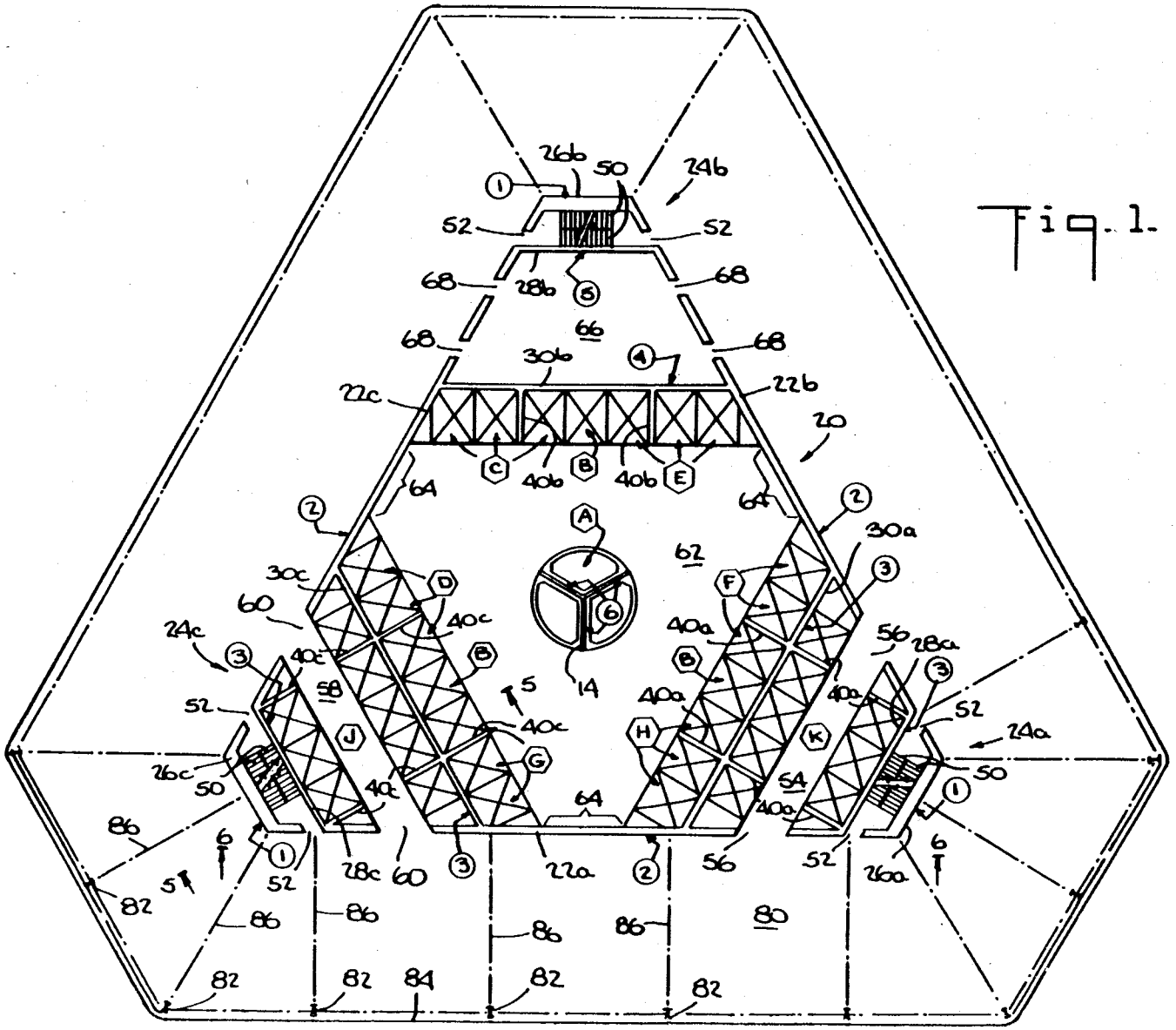
FIG. 1 is a simplified plan view of the lower lobby level of a 150-storey building which is the first illustrative embodiment of the invention.
Figure 2:
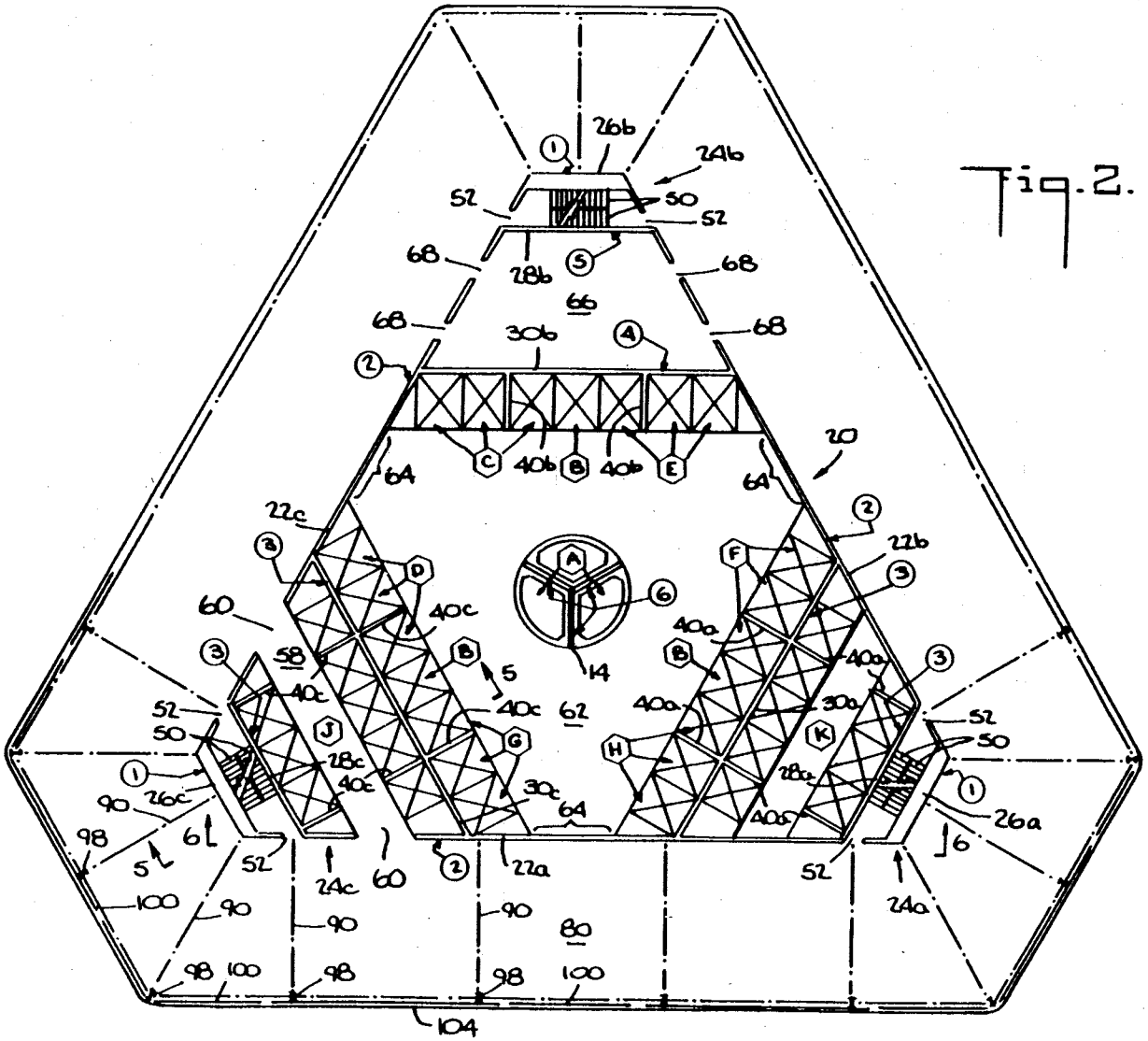
FIG. 2 is a simplified plan view which is typical of the upper floors in the first illustrative embodiment.
Figure 4:
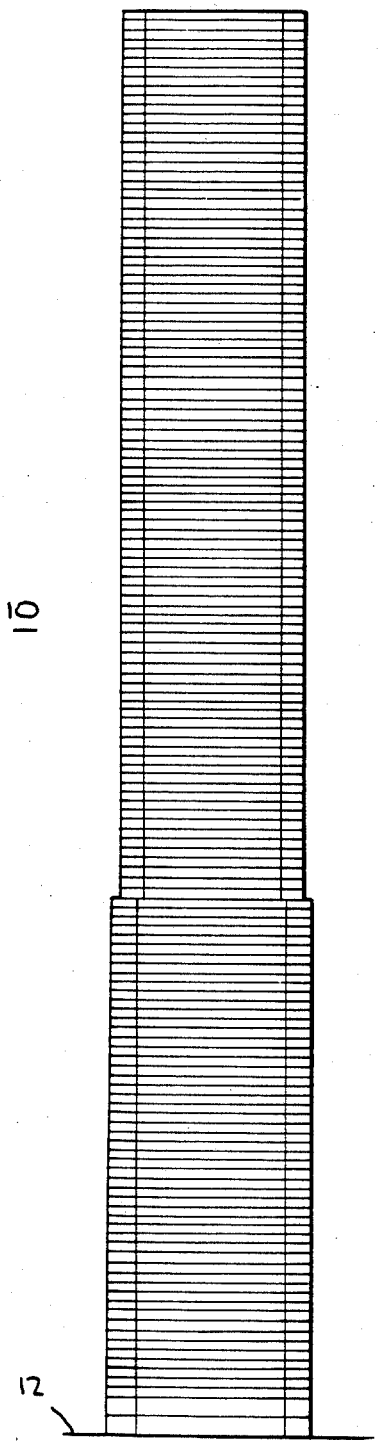
FIG. 4 is a building elevation showing the width-height proportions of the first illustrative embodiment.
Figure 8:
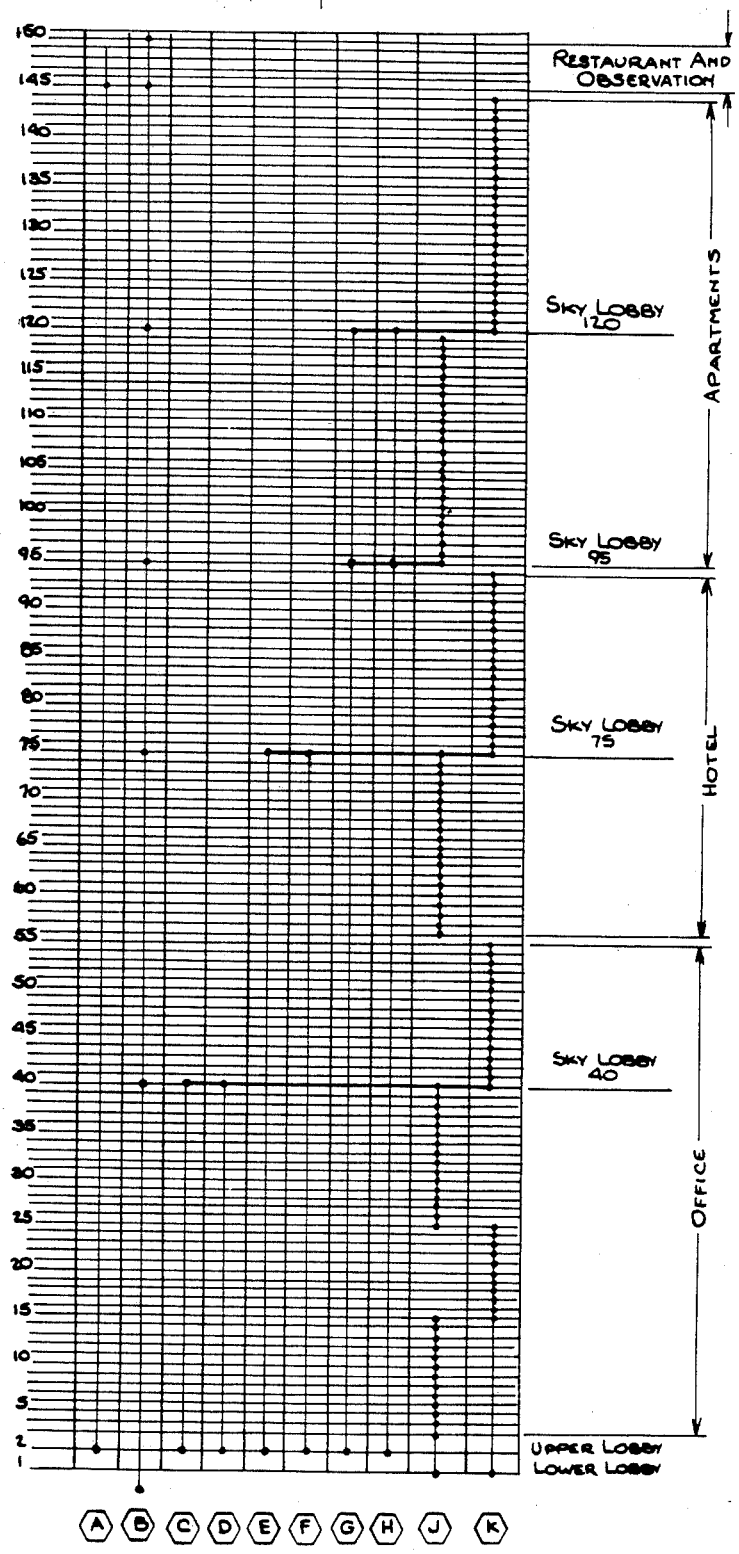
FIG. 8 is a schematic diagram of the elevator system in the first illustrative embodiment.

As shown in FIG. 4, a first illustrative embodiment of the invention is a building 10 resting on a foundation 12 and having 150 stories. Although any use may be made of such a structure, for illustrative purposes it is assumed (as shown in FIG. 8) that floors 1–55 are "office" floors, floors 56–94 are "hotel" floors, floors 95–144 are "apartment" floors, and floors 145–150 are any desired combination of "restaurant" and "observation" floors (some of which may be omitted to increase the ceiling height of the included floors). Although again other floor size and shape patterns may be employed, in the depicted building floors 1–55 are all of the same size and shape, and floors 56–150 are also all of the same size and shape, but slightly smaller than floors 1–55. FIG. 1 is a plan view of the lower lobby level or first floor, and FIG. 2 is a plan view of floor which is typical for floors above the two lobby levels, and especially the upper floors which are entirely supported by the reinforced concrete prism described in detail below. In plan view building 10 is basically an equilateral triangle. Other plan view shapes may be employed, but the depicted equilateral triangular shape is particularly advantageous and therefore preferred for reasons that will become apparent as the description proceeds.

The main structural element of building 10 is a hollow, reinforced concrete prism 20, which is visible in horizontal cross section in each of FIGS. 1 and 2. Most of the human-occupiable floor space in building 10 is outside prism 20. Prism 20 extends from foundation 12 through the 150th floor. Although defined herein as a prism, prism 20 has some secondary non-prismatic features. For one thing, the wall thickness of prism 20 may increase somewhat toward the bottom of building 10 to increase the load-bearing capacity of the lower portions of the prism (see FIG. 7, which shows the thicknesses of most of the walls that make up prism 20, and which is keyed to the various wall types shown in FIGS. 1 and 2 by the reference numbers in circles). Prism 20 also includes horizontal apertures (e.g., apertures 52, 56, etc.) at various floor levels to permit human movement between the inside and outside of the prism via those apertures. Preferably, however, at substantially no horizontal cross section of prism 20 does the sum of the widths of all such apertures exceed about 25% of the outer peripheral circumference of the prism. Prism 20 may also include other similar minor deviations from a true prism (e.g., horizontal interior floor surfaces 54, 58, etc.), but it is still basically prismatic in character and is accordingly defined herein as a prism.

Prism 20 includes a number of integral parts. The main parts of prism 20 are three substantially planar, vertical, main walls 22*a*, 22*b*. and 22*c*, each of which (in plan view) forms a respective side of an equilateral triangle (the apexes or corners of which are somewhat truncated). The adjacent vertical edge portions of main walls 22 are integrally interconnected by corner structures 24. In particular, corner structure 24*a* integrally interconnects the adjacent vertical edge portions of main walls 22*a* and 22*b*; corner structure 24*b* integrally interconnects the adjacent vertical edge portions of main walls 22*b* and 22*c*; and corner structure 24*c* integrally interconnects the adjacent vertical edge portions of main walls 22*c* and 22*a*.

Each of corner structures 24 includes a corner pier 26 and a plurality of secondary walls 28 and 30, all of which are substantially planar, vertical wall structures which, for any given corner structure, are parallel to one another. For example, corner structure 24*a* includes corner pier 26*a* which integrally interconnects the adjacent vertical edges of main walls 22*a* and 22*b*. The angle subtended by main wall 22*a* and corner pier 26*a* is equal to the angle subtended by corner pier 26*a* and main wall 22*b*. Secondary walls 28*a* and 30*a* are both parallel to corner pier 26*a*, and each is located progressively farther into the interior of prism 20. The respective corner pier 26 and secondary walls 28 and 30 comprising each corner structure 24 are basically the same.

Corner structures 24 also include some substantially planar, vertical, tertiary walls 40, each of which is perpendicular to and integral with one of secondary walls 28 and 30. As will be more apparent hereinafter, the secondary and tertiary walls at least partially define most of the elevator runways serving the building and also help to support and distribute the load of the elevators operating along those runways. Unlike the other wall structures described above, some of tertiary walls 40 may not extend continuously along the entire height of the building, but may instead be provided only where needed to define the associated elevator runways (see, for example, FIG. 5 which shows, in conjunction with FIG. 8, that the tertiary walls 40*c* between secondary walls 28*c* and 30*c* are provided only adjacent to the portions of elevator bank J that are actually occupied by elevators).

Each corner structure 24 includes emergency stairways 50 in the space between the associated corner pier 26 and secondary wall 28. Access to these stairways is via apertures 52 in main walls 22 of prism 20. Apertures 52 are preferably located at every floor level (see FIG. 6).

As mentioned above, secondary walls 28*a*, 28*c*, and 30 (augmented in some cases by tertiary walls 40) define most of the runways for the elevators serving the building. These walls (together with the remainder of prism 20) also support the elevators operating along the associated runways. Express elevators to the restaurant and observation floors operate along a central, vertical, reinforced concrete spine structure 14 inside prism 20. (These restaurant and observation floors may be interconnected by any desired arrangement of escalators, stairs, and/or local elevators (not shown).) There are ten banks of elevators designated A-H, J, and K (these reference letters are in hexagons). FIG. 8 is a schematic diagram of the elevator system. The locations of the elevators are evident from FIGS. 1 and 2.

Elevator bank A comprises three express elevators operating along spine structure 14. These elevators stop only at the upper lobby level and the 145th floor restaurant and observation level. Elevator bank B comprises three elevators which may be so-called service elevators. These elevators stop only at a basement level (below the lower lobby level) and at floors 40, 75, 95, 120, 145, and 150. Elevator banks C-H each comprise three express elevators. The elevators in banks C and D stop only at the upper lobby level and at the 40th floor sky lobby level. The elevators in banks E and F stop only at the upper lobby level and at the 75th floor sky lobby level. The elevators in banks G and H stop only at the upper lobby level and at the 95th and 120th floor sky lobby levels. All of the elevators in banks B-H operate along the inner surfaces of secondary walls 30.

Each of elevator banks J and K comprises eight elevator runways, each of which has several short-haul elevators operating at various levels in the building. Elevator bank J has three elevator runways side-by-side along the inner surface of secondary wall 28*c* and five more elevator runways side-by-side along the outer surface of secondary wall 30*c*. Similarly, elevator bank K has three elevator runways side-by-side along the inner surface of secondary wall 28*a* and five more elevator runways side-by-side along the outer surface of secondary wall 30*a*.

The lowest portion of elevator bank J is used for eight local elevators that stop at the lower lobby level and at floors 3–15. Above these eight elevators are eight more completely separate and independent local elevators that stop at floors 25–40. Above these eight elevators are eight more separate and independent local elevators that stop at floors 56–75. And above these eight elevators are eight more separate and independent local elevators that stop at floors 95–119. The lowest portion of elevator bank K is used for eight express-local elevators that stop at the lower lobby level and at floors 15–25. Above these eight elevators are eight more completely separate and independent local elevators that stop at floors 40–55. Above these eight elevators are eight more separate and independent local elevators that stop at floors 75–94. And above these eight elevators are eight more separate and independent local elevators that stop at floors 120–144.

To illustrate the operation of the above-described elevator system, to get from the building entrance to the 30th floor, one would take one of the express elevators in banks C or D from the upper lobby level to the 40th floor sky lobby level and change there to one of the local elevators in the associated intermediate portion of bank J. This local elevator is ridden down to the 30th floor. To get from the building entrance to the 100th floor, one would take one of the express elevators in banks G or H from the upper lobby level to the 95th floor sky lobby level and change there to one of the local elevators in the associated upper portion of bank J. This local elevator is ridden up to the 100th floor.

Figure 5:
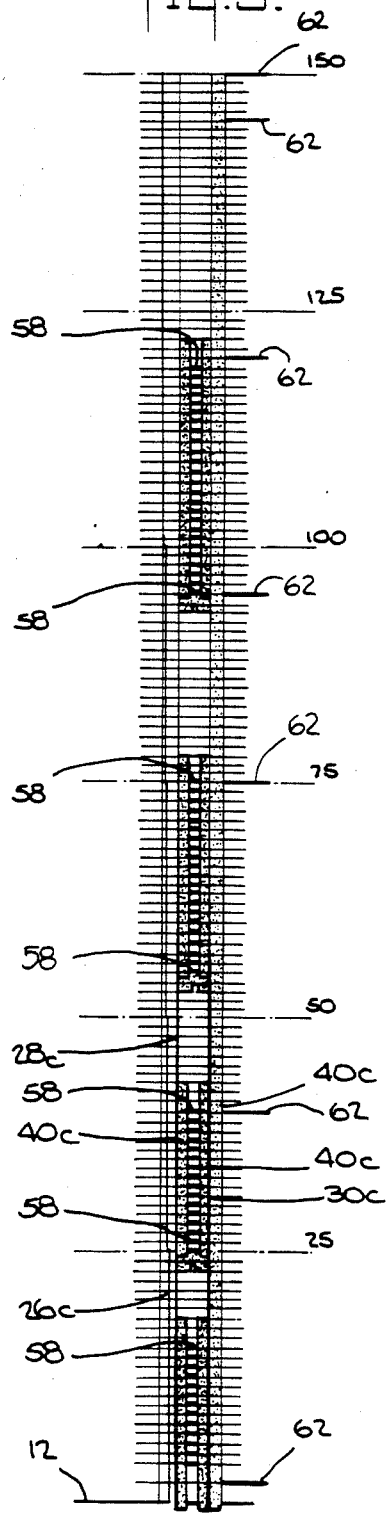
FIG. 5 is a section taken along the line 5—5 in FIGS. 1 and 2, showing the occurrence of cross walls, floors, and elevator divider walls.

In general, horizontal floors are provided in prism 20 only where such floors are needed for elevator landings (see FIG. 5 which shows the locations of the floors in and adjacent to representative corner structure 24*c*). Thus horizontal floors (reference number 58) may be provided between walls 28*c* and 30*c* only at floors served by the elevators in elevator bank J (i.e., at the lower lobby level and at floors 3–15, 25–40, 56–75, and 95–119). Similarly, horizontal floors (reference number 54) may be provided between walls 28*a* and 30*a* only at floors served by the elevators in elevator bank K (i.e., at the lower lobby level and at floors 15–25, 40–55, 75–94, and 120–144). By the same token, horizontal floors (reference number 62) may be provided in the space surrounded by walls 30 only at floors served by the elevators in elevator banks A-H (i.e., at the upper lobby level and at floors 40, 75, 95, 120, 145, and 150). Between these floors 62, open atriums may be left in the space surrounded by walls 30. Floors 62 provide lateral support for spine structure 14.

Figure 6:
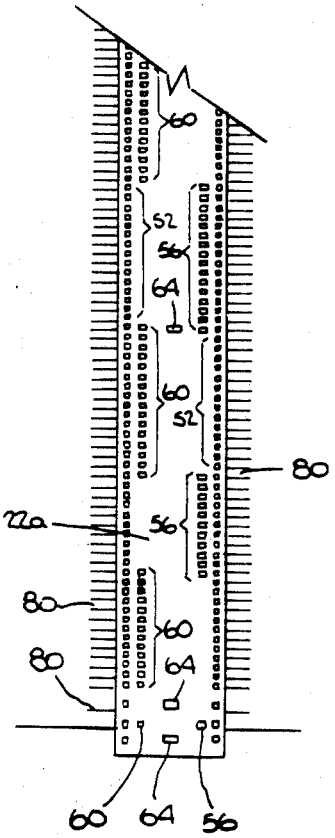
FIG. 6 is a partial elevational section taken along the line 6—6 in FIGS. 1 and 2.

Apertures 56 are provided through main walls 22*a* and 22*c* only where needed to permit access to floors 54 (i.e., only at the lower lobby level and at floors 15–25, 40–55, 75–94, and 120–144; see FIG. 6). Similarly, apertures 60 are provided through main walls 22*a* and 22*b* only where needed to permit access to floors 58 (i.e., only at the lower lobby level and at floors 3–15, 25–40, 56–75, and 95–119). Apertures 64 (shown schematically) are provided through main walls 22 only where needed to permit access to floors 62 (i.e., at the upper lobby level and at floors 40, 75, 95, 120, 145, and 150). Accordingly, to travel from the building entrance to the 100th floor, one would enter prism 20 via one of apertures 64 at the upper lobby level and take one of the express elevators in bank G or H to the 95th floor sky lobby. There one would exit the express elevator and walk across the sky lobby floor 62 to exit prism 20 via one of the apertures 64 adjacent to elevator bank J. One would then walk along the exterior 95th floor, pass through the nearest aperture 56, and enter one of the local elevators in elevator bank J for the ride up to the 100th floor. At the 100th floor, one would exit the local elevator and leave prism 20 via one of the apertures 56 at the 100th floor.

Corner structure 24*b* differs from the other corner structures in that it does not include a local elevator bank. Instead, the space between walls 28*b* and 30*b* is used for other purposes such as mechanical and electrical rooms, lavatories, locker rooms, storage areas, etc. Access to the floors 66 of these areas is via apertures 68 through main walls 22*b* and 22*c*.

To the extent that floors 54, 58, 62, and 66 are provided inside prism 20, these floors are preferably reinforced concrete integral with prism 20. Additional steel framing (not shown) may be provided in the interior of prism 20 for such purposes as supporting these floors, bracing the corner structure walls, and partially defining the elevator runways.

As mentioned above, FIG. 7 is a table showing illustrative preferred thicknesses (as a function of floor level) for the various walls that make up prism 20. Tertiary walls 40 are preferably approximately 8 inches thick. The preferred material for all of these walls is conventional reinforoed concrete, the concrete having an allowable compression stress of 10,000 p.s.i. at 28 days.

Figure 7:
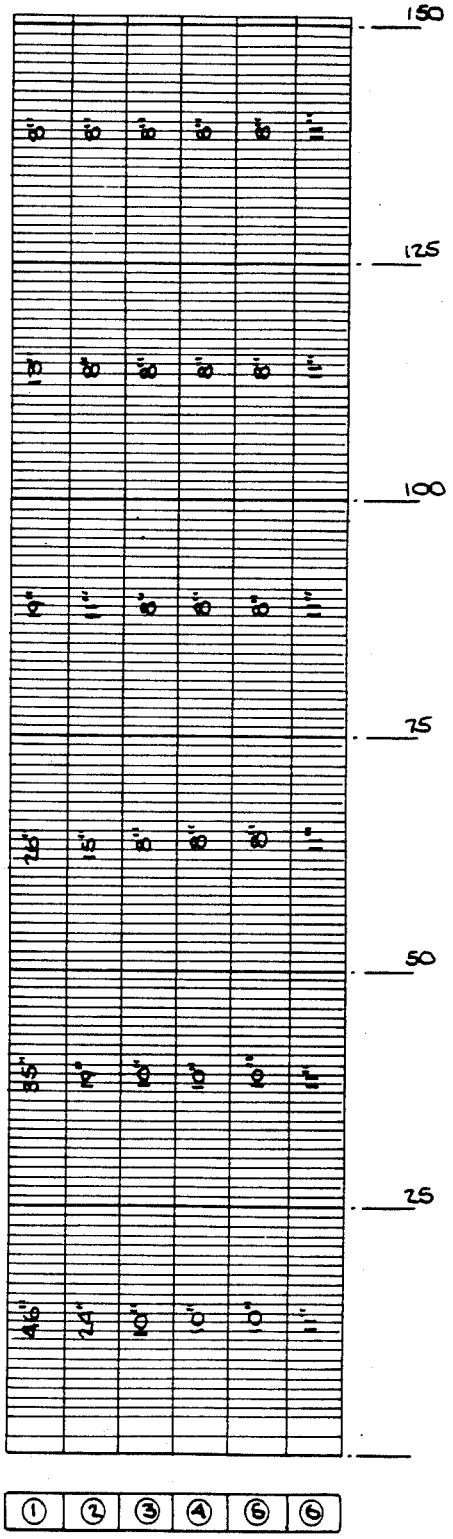
FIG. 7 is a schedule of preferred wall thicknesses for the first illustrative embodiment.

Although FIG. 7 shows that corner piers 26 can decrease in thickness toward the top of the building, it may be more economical to have corner piers 26 uniformly thick (e.g., 46 inches thick) from the bottom to the top of the building. It should also be emphasized that the wall thicknesses shown in FIG. 7 are merely illustrative. For example, if the building is to be located in an area subject to particularly high winds and/or strong earthquakes, thicker corner piers 26 may be employed to resist those increased loads.

As mentioned above, most of the human-occupied space in building 10 is outside prism 20. In particular, at each floor level there is an annular exterior floor surface 80 outside prism 20 which extends all the way around the prism. Prism 20 therefore forms the inner partitioning wall for this exterior floor space. Some of the weight of lower floors 80 is borne by prism 20, while the remaining weight of those floors is borne by exterior structural columns 82 which are mounted on foundation 12. Columns 82 may be of any suitable material such as reinforced concrete or structural steel, the latter being preferred and depicted. An exterior partitioning or enclosing wall 84 is provided between columns 82. A system of horizontal beams and joists 86 is provided between prism 20 and columns 82 to support lower floors 80.

Figure 3:
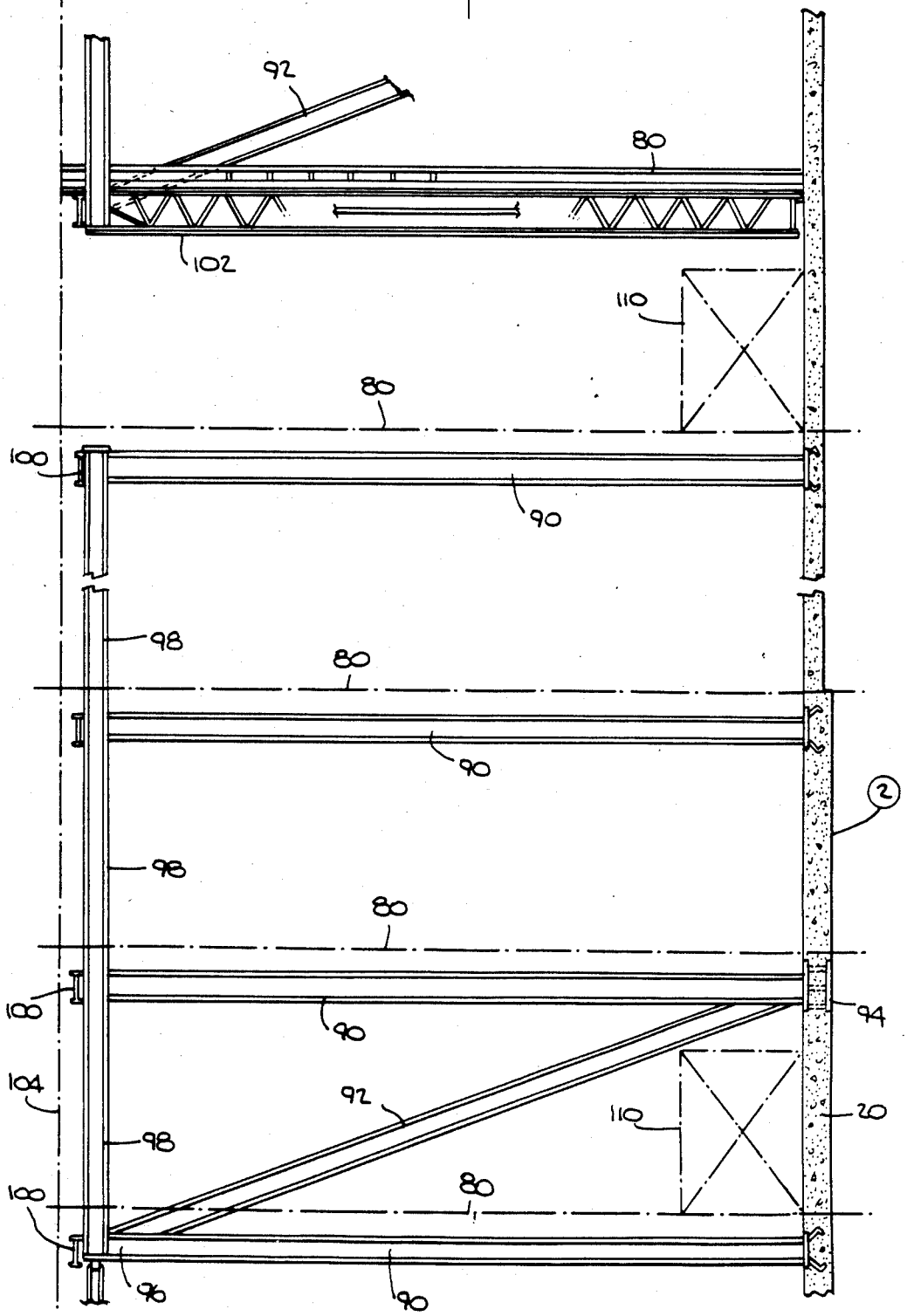
FIG. 3 is a simplified, partial elevational view of the structure used to support the cantilevered upper floors in the first illustrative embodiment, and also used for the same purpose in the other depicted embodiments.

From at least about the 75th floor up, floors 80 are cantilevered outwardly from and completely supported by prism 20. FIG. 3 shows the manner in which this is accomplished. Horizontal structural steel beams 90 extend out from prism 20 below the level of each cantilevered floor 80. The cantilevered floors are grouped in groups of approximately five vertically adjacent floors. (FIG. 3 depicts (at the bottom) the three lowermost floors 80 and the one uppermost floor 80 in one such group of approximately five floors, and the lowermost floor 80 in the next higher group.) A diagonal structural steel brace 92 extends from the prism anchorage 94 of each of the beams 90 associated with the next-to-lowest floor in each group to the outermost end 96 of the beam 90 directly below. Vertical exterior structural steel columns 98 connect the outermost ends of all of the vertically aligned beams 90 in each group of approximately five floors. Horizontal structural steel members 100 extend between columns 98 adjacent the outermost ends of beams 90. Joists 102 provide additional support for floors 80. Exterior partitioning or enclosing walls 104 are supported by members 98 and 100.

The frame structures just described (principally elements 90, 92, and 98), all of which are completely supported by prism 20, therefore support associated floors 80 (in groups of approximately five) so that all of the weight of these floors is borne by prism 20. It should be noted that the above-described frame structures are constructed so that diagonal braces 92 do not block corridors 110 which pass just outside prism 20.

Among the advantages of the structure described above are the following: Prism 20, which is the main structural element of the building, is made up almost exclusively of reinforced concrete walls. Reinforced concrete is relatively inexpensive, and walls are both relatively efficient structural members and much less expensive to construct than comparable steel beam and column structures. In addition, the walls of prism 20 double as many of the necessary partitioning walls of the structure, thereby eliminating the expense of separate partitioning walls. Similarly, some of the walls of prism 20 also serve as necessary elevator runways, thereby reducing the cost of the elevator system. Substantially continuous main walls 22, interconnected at their adjacent vertical edge portions by substantially continuous corner structures 24 (also made up of substantially continuous walls 26, 28, 30, 32, etc.), provide an extremely efficient structure for distributing and resisting horizontal loads due to wind, which are the principal limiting factors in the design of extremely tall but slender buildings. As noted in the above-mentioned magazine articles, present structures are limited to aspect ratios (the ratio of height to width at the structural base) in the range of about 6:1. With the present invention, extremely stable buildings with cores having aspect ratios of 10:1, 12:1, or more are easily and economically attainable. The aspect ratio of building 10 is approximately 7:1. The aspect ratio of prism 20 alone is approximately 13:1.

Among the other advantages of the invention is the fact that the interior space of the building, which is of relatively low commercial value, is inside prism 20 where it is available for such necessary purposes as elevator runways and landings, emergency stairways, mechanical and electrical space, lavatories, storage space, etc. To the extent that this interior space is not needed for these purposes, it can be left completely unused, even without floors except where floors are needed.

The basically equilateral triangular shape of the especially preferred and depicted embodiment also provides an extremely strong and rigid prism 20, the corner structures 24 of which are especially effective in bracing the adjacent main walls 22 and in transmitting shear forces (due to wind loading) between main walls 22. The equilateral triangular shape also provides corner structures 24 that can be efficiently used for elevator banks. The symmetry of the equilateral triangular shape is also desirable from a structural standpoint.

Figure 9:
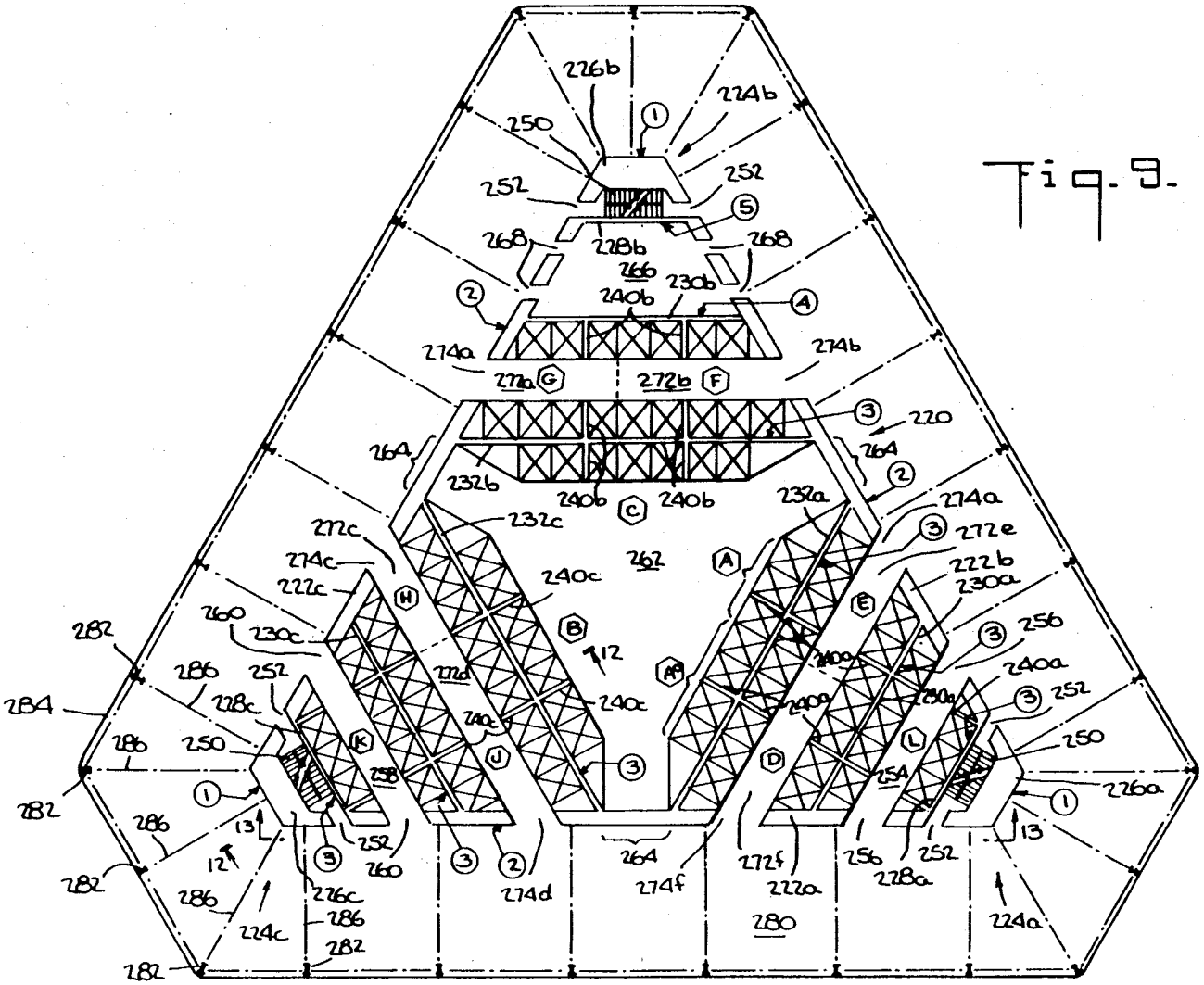
FIG. 9 is a simplified plan view of the lower lobby level of a 250-storey building which is the second illustrative embodiment of the invention.
Figure 10:
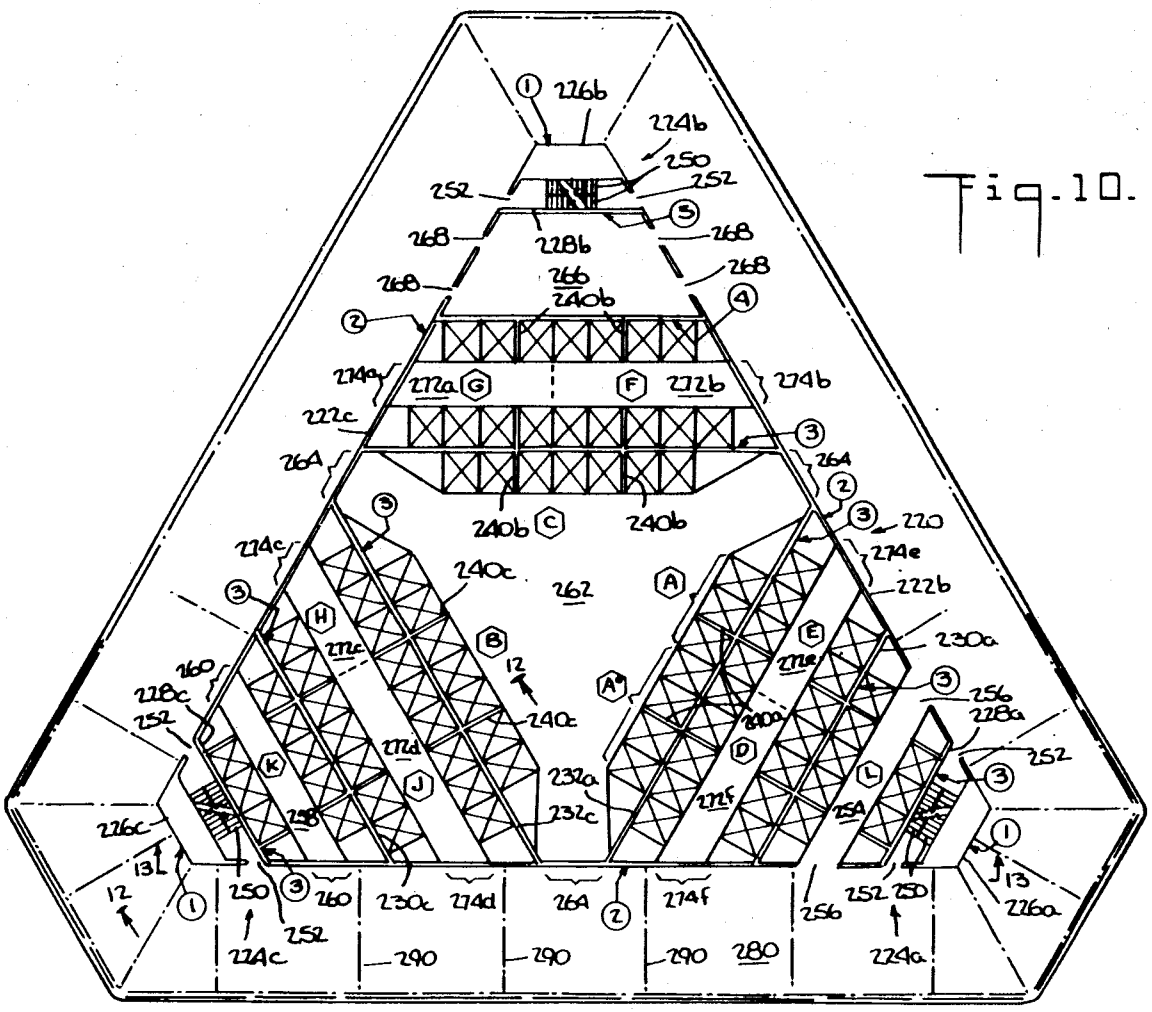
FIG. 10 is a simplified plan view which is typical of the upper floors in the second illustrative embodiment.
Figure 11:
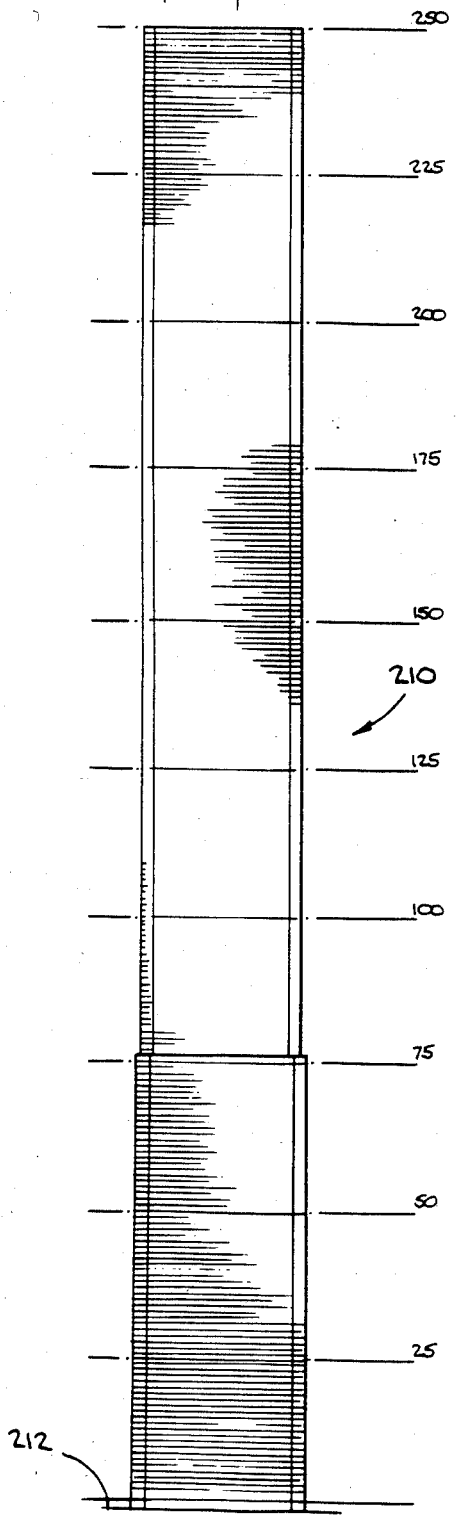
FIG. 11 is a building elevation showing the width-height proportions of the second illustrative embodiment.

FIG. 11 shows a 250 storey building 210 mounted on foundation 212 and constructed in accordance with the principles of this invention. FIG. 9 is a plan view of the lower lobby level or first floor of building 210. FIG. 10 is a plan view of a floor which is typical for the upper floors of building 210. Floors 245–250 are "restaurant" and "observation" floors, some of which may be omitted to increase the ceiling height of the remaining floors (see FIG. 15). As at the top of building 10, these restaurant and observation floors may be interconnected by any desired arrangement of escalators, stairs, and/or local elevators (not shown).

Building 210 has many features in common with building 10, and elements in building 210 that are similar to elements in building 10 have reference numbers that are 200 more than the corresponding building 10 reference numbers.

Like building 10, building 210 is basically an equilateral triangle in plan view, although the corners of the triangle are again somewhat truncated. Floors 1–75 are slightly larger than floors 76–250.

As in building 10, the main structural element of building 210 is vertically oriented, reinforced concrete prism 220. Most of the human-occupied floor space in building 210 is outside prism 220. Whereas for floors 1–75 some of the load of this exterior floor space may be shared by prism 220 and exterior columns 282, at least from floor 76 up all weight of this exterior floor space is carried by prism 220. The exterior floors for which all support is thus provided by prism 220 are cantilevered from prism 220 as described above in relation to FIG. 3.

Prism 220 has three substantially planar, vertical main walls 222*a*, 222*b*, and 222*c*, each of which is coincident with or parallel to a respective one of the sides of a horizontal, equilateral triangle. The adjacent vertical edge portions of walls 222 are interconnected by integral, vertically oriented corner structures 224. Each corner structure 224 comprises a corner pier 226 and a plurality of secondary walls 228, 230, and 232, each of which is a substantially planar vertical wall extending between the two associated main walls 222. For any given corner structure, all of walls 226, 228, 230, and 232 are parallel to one another. The included angle between each end of each of these walls and the adjacent main wall is the same at both ends of each of these walls 226, 228, 230, and 232. Secondary walls 228*a*, 228*c*, 230, and 232 are braced by substantially planar, parallel, vertical tertiary walls 240, each of which is perpendicular to the associated secondary wall. Substantially horizontal steel framing (not shown) may be provided in the interior of prism 220 for such purposes as providing further bracing for the secondary and tertiary walls, supporting floors inside prism 220, and partially defining the elevator runways that are further defined by the secondary and tertiary walls.

Emergency stairways 250 are provided between the corner pier 226 and secondary wall 228 in each corner structure 224. Access to these stairways is via apertures 252 in prism 220.

Figure 12:
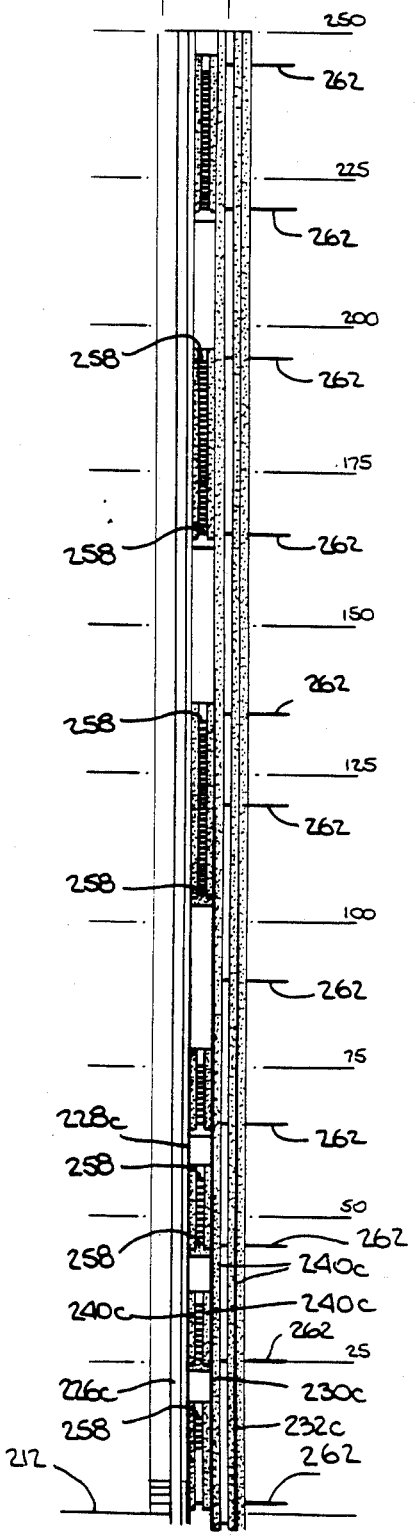
FIG. 12 is a section taken along the line 12—12 in FIGS. 9 and 10, showing the occurrence of cross walls, floors, and elevator divider walls.
Figure 15:
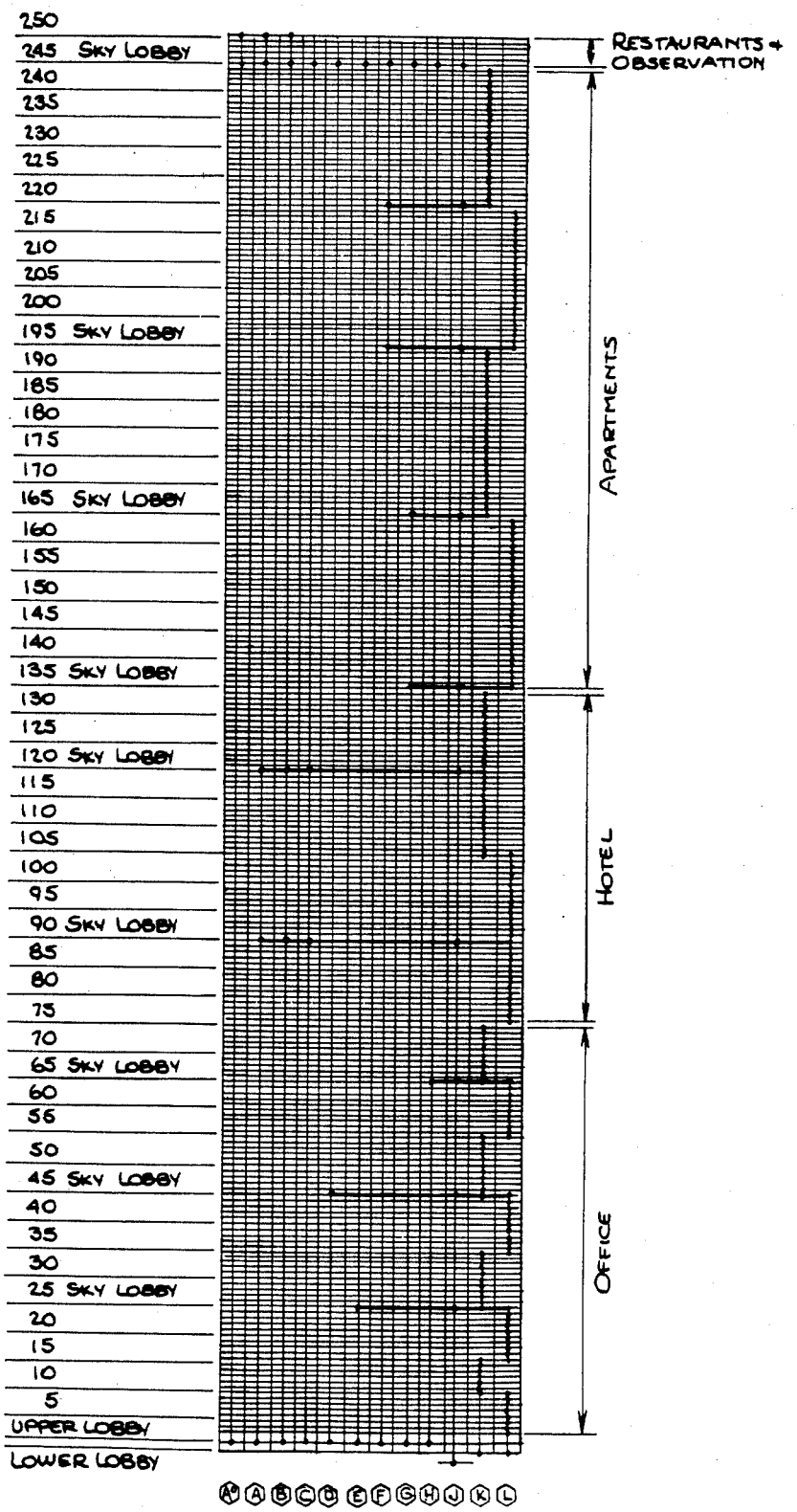
FIG. 15 is a schematic diagram of the elevator system in the second illustrative embodiment.

Building 210 is served by twelve elevator banks, all of which are located inside prism 220. FIG. 15 is a schematic diagram of the elevator system, and FIG. 12 is a schematic diagram of the locations of the horizontal floors in illustrative corner structure 224*c* which principally serve as elevator landings. The locations of the elevators are apparent from FIGS. 9 and 10 (reference letters in hexagons). Elevator banks A-J are high speed, express elevator banks. For example, the four elevators of bank AO operate along runways at least partly defined by the inner surface of wall 232*a* and stop only at the upper lobby level and floors 245 and 250. The three elevators of bank A also operate along runways at least partly defined by the inner surface of wall 232*a* and stop only at the upper lobby level and at floors 90, 120, 245, and 250. The seven elevators of bank B operate along runways at least partly defined by the inner surface of wall 232*c* and make the same stops as the elevators in bank A. The seven elevators of bank C operate along runways at least partly defined by the inner surface of wall 232*b* and make the same stops as the elevators in banks A and B, excluding floor 250. The nine elevators of bank D operate along runways at least partly defined by the inner surface of wall 232*a* and the outer surface of wall 230*a*, and stop only at the upper lobby level and at floors 45 and 245. The seven elevators of bank E are similarly located and stop only at the upper lobby level and at floors 25 and 245. The nine elevators of bank F are located between walls 230*b* and 232*b* and stop only at the upper lobby level and at floors 195, 220, and 245. The seven elevators of bank G are similarly located and stop only at the upper lobby level and at floors 135, 165, and 245. The five elevators of bank H are located between walls 230*c* and 232*c* and stop only at the upper lobby level and at floors 65 and 245. The eleven elevators of bank J are similarly located. These are service elevators which stop only at a basement level and at floors 25, 45, 65, 90, 120, 135, 165, 195, 220, and 245.

Each of elevator banks K and L includes eight elevator runways, each of which is reused by completely separate, low speed, local elevators at seven separate elevations in the building. Three of the elevator runways in bank K are at least partly defined by wall 228*c*, while the remaining runways in bank K are at least partly defined by wall 230*c*. The runways in bank L have the same relationship to walls 228*a* and 230*a*. The eight lowest elevators in bank L stop at the lower lobby level and at floors 3–10. The eight lowest elevators in bank K stop at the lower lobby level and at floors 10–15. The eight next-higher elevators in bank L stop at floors 15–25, and the eight next-higher elevators in bank K stop at floors 25–35. Each of the runways in banks K and L is reused in this manner so that all floors in the building are served by local elevators in one or both of these banks. Thus to get to the 20th floor, one would ride a bank E express elevator from the upper lobby level to the 25th floor and change there to one of the bank L local elevators in order to ride down to the 20th floor.

Figure 13:
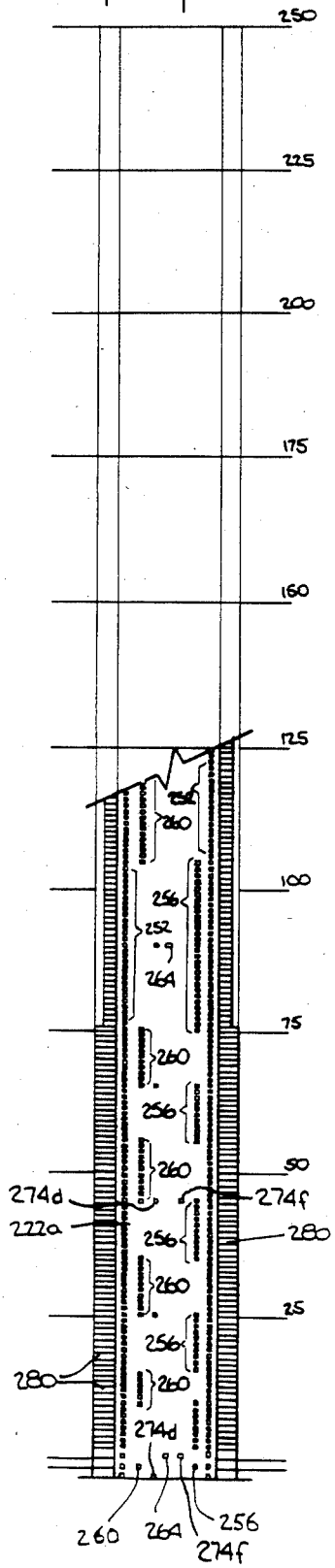
FIG. 13 is a partial elevational section taken along the line 13—13 in FIGS. 9 and 10.

As mentioned above, prism 220 has interior floors for the most part only where needed as elevator landings (see FIG. 12 which shows the locations of the floors in representative corner structure 224*c*). For example, floors 254, which serve as landings for the elevators in bank L, are provided only at the floors at which those elevators stop (i.e., the lower lobby level and floors 3–10, 15–25, 35–45, 55–65, 76–105, 135–164, and 195–219). Access to floors 254 is afforded by apertures 256 in prism 220, which apertures are also provided only where there are floors 254 (see FIG. 13). Similarly, floors 258 are provided only at the floors at which the bank K elevators stop (i.e., the lower lobby level and floors 10–15, 25–35, 45–55, 65–75, 105–134, 165–194, and 220–244). Apertures 260, which afford access to floors 258, are provided in prism 220 only where there are floors 258 (see FIG. 13). Floors 272*a*, which serve as landings for the elevators in bank G, are provided only at the upper lobby level and at floors 135, 165, and 245. (Floors 272*a* may also be provided elsewhere for such purposes as providing intermediate emergency landings for the elevators in bank G.) Apertures 274*a* are provided in prism 220 only where necessary to afford access to floors 272*a*. Floors 272*b* and apertures 274*b* (associated with elevator bank F), floors 272*c* and apertures 274*c* (associated with elevator bank H), floors 272*d* and apertures 274*d* (associated with elevator bank J), floors 272*e* and apertures 274*e* (associated with elevator bank E), and floors 272*f* and apertures 274*f* (associated with elevator bank D) are all respectively similar to elements 272*a* and 274*a* and are provided on the same basis as those elements. Floors 262, which serve as landings for the elevators in banks A, B, and C, may be provided only at the upper lobby level and at floors 90, 120, 245, and 250. Apertures 264 (shown schematically in FIGS. 9 and 10) are only provided adjacent to floors 262.

In corner structure 224*b* the space between walls 228*b* and 230*b* can be used for such purposes as lavatories, mechanical and electrical space, etc. Accordingly, floors 266 are provided in this area at every floor, and every floor is also afforded access to this area via apertures 268 in prism 220.

Figure 14:
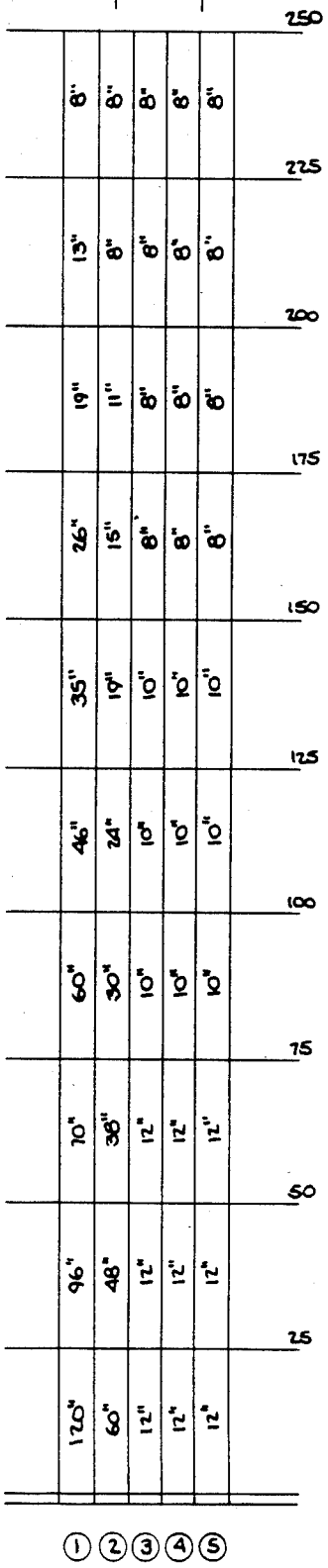
FIG. 14 is a schedule of preferred wall thicknesses for the second illustrative embodiment.

FIG. 14 is a table showing illustrative preferred thicknesses (as a function of floor level) for most of the walls that make up prism 220. (FIG. 14 is keyed to FIGS. 9 and 10 by the wall-type reference numbers in circles.) Tertiary walls 240 are preferably approximately 8 inches thick. The preferred material for all of these walls is conventional reinforced concrete, the concrete having an allowable compression stress of 10,000 p.s.i. at 28 days. The comments made above concerning the possible use of uniformly thick corner piers 26 in building 10 apply equally to corner piers 226 in building 210. The same is true of the comments made above concerning the use of thicker corner piers if the building is to be located in an area of high winds and/or strong earthquakes.

Figure 16:
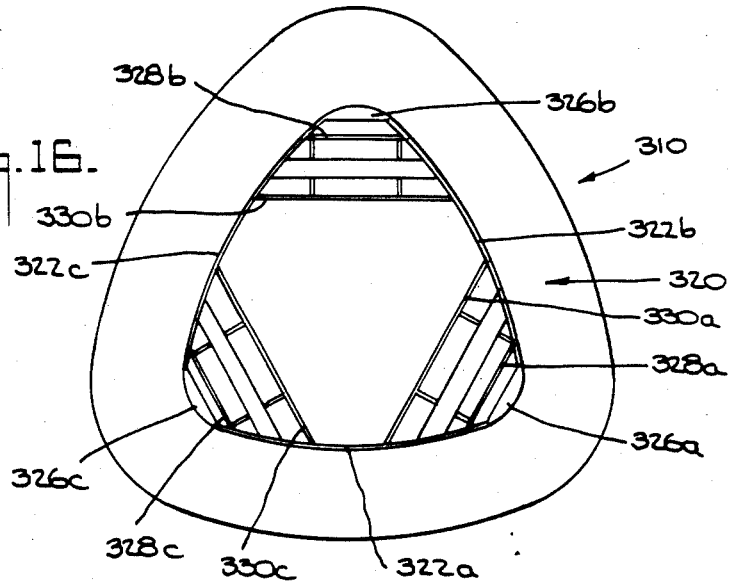
FIG. 16 is a simplified plan view of a third illustrative embodiment of the invention.
Figure 17:
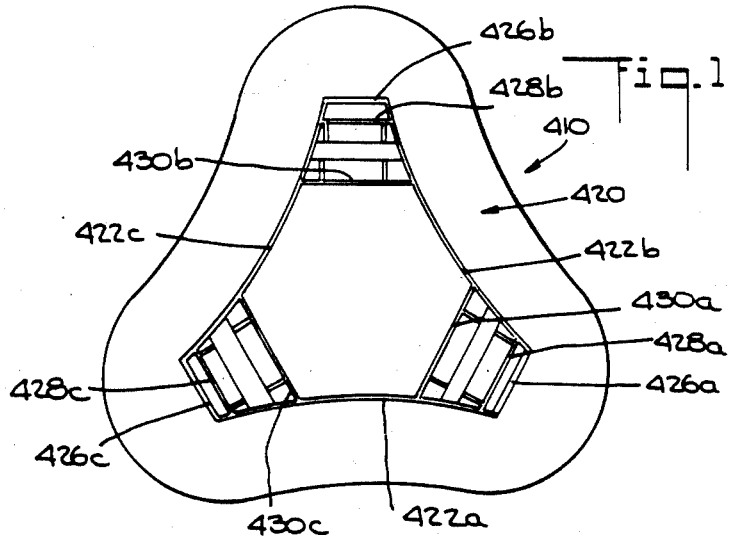
FIG. 17 is a simplified plan view of a fourth illustrative embodiment of the invention.
Figure 18:
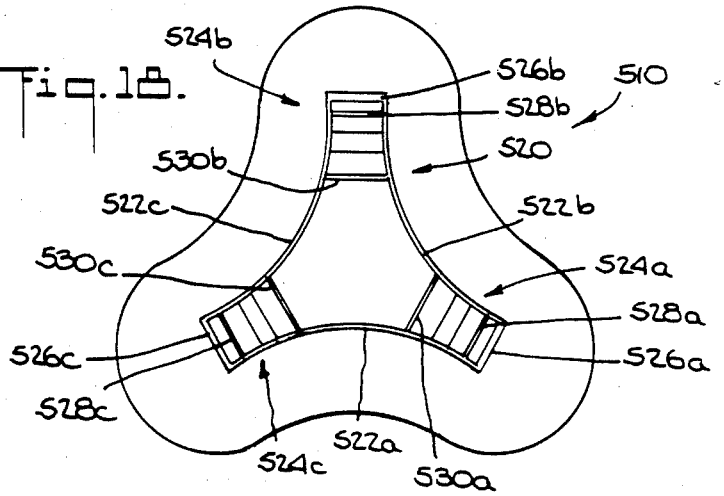
FIG. 18 is a simplified plan view of a fifth illustrative embodiment of the invention.

Although the sides of buildings 10 and 210 are perfectly planar, this is not necessarily the case. For example, FIG. 16 is a plan view of an alternative embodiment 310 of the invention in which the main walls 322 of prism 320 are convex and the outer surfaces of corner piers 326 are also convex. Secondary walls 328 and 330 remain planar. FIG. 17 is a plan view of another alternative embodiment 410 of the invention in which the main walls 422 of prism 420 are concave but corner piers 426 and secondary walls 428 and 430 are planar. FIG. 18 is a plan view of yet another alternative embodiment 510 of the invention in which the main walls 522 of prism 520 are again concave, while corner structures 524 (including corner piers 526 and secondary walls 528 and 530) are somewhat more extended than in FIG. 17. Despite the foregoing modifications, all of the embodiments of FIGS. 16–18 are defined herein as substantially equilateral triangles having substantially planar sides.

While the invention has been described in the context of several particularly preferred embodiments, those skilled in the art will recognize that it can be characterized in other terms and embodied in other forms. For example, the main structural element of the buildings of this invention can be thought of as a series of alternating corner piers and main walls, all of which are integrally interconnected, vertically oriented, reinforced concrete members (see FIGS. 19 and 20 which show a somewhat more generalized form of the invention). Only the corner piers 626 need to go all the way down to foundation 612. The interspersed main walls 622 can stop above the foundation to facilitate access via aperture 623 to the lower or lobby floors. Thus main walls 622 are not necessarily coextensive with the entire height of those associated corner piers 626, but they are coextensive with a major portion (preferably at least about 80%) of the height of those corner piers. Main walls 622 can be thought of as very deep beams which brace corner piers 626 against one another and transmit load to the corner piers. Although apertures (not shown in FIGS. 19 and 20 but similar to apertures 52, 56, 60, etc., in the previously described embodiments) may be provided in main walls 622 to allow human movement through those walls, in order for main walls 622 to retain the characteristic of walls, the portion of any main wall horizontal axis which is occupied by such apertures is preferably less than about 33% of that horizontal axis (e.g., less than about 33% of dimension X in FIG. 19).

Figure 19:
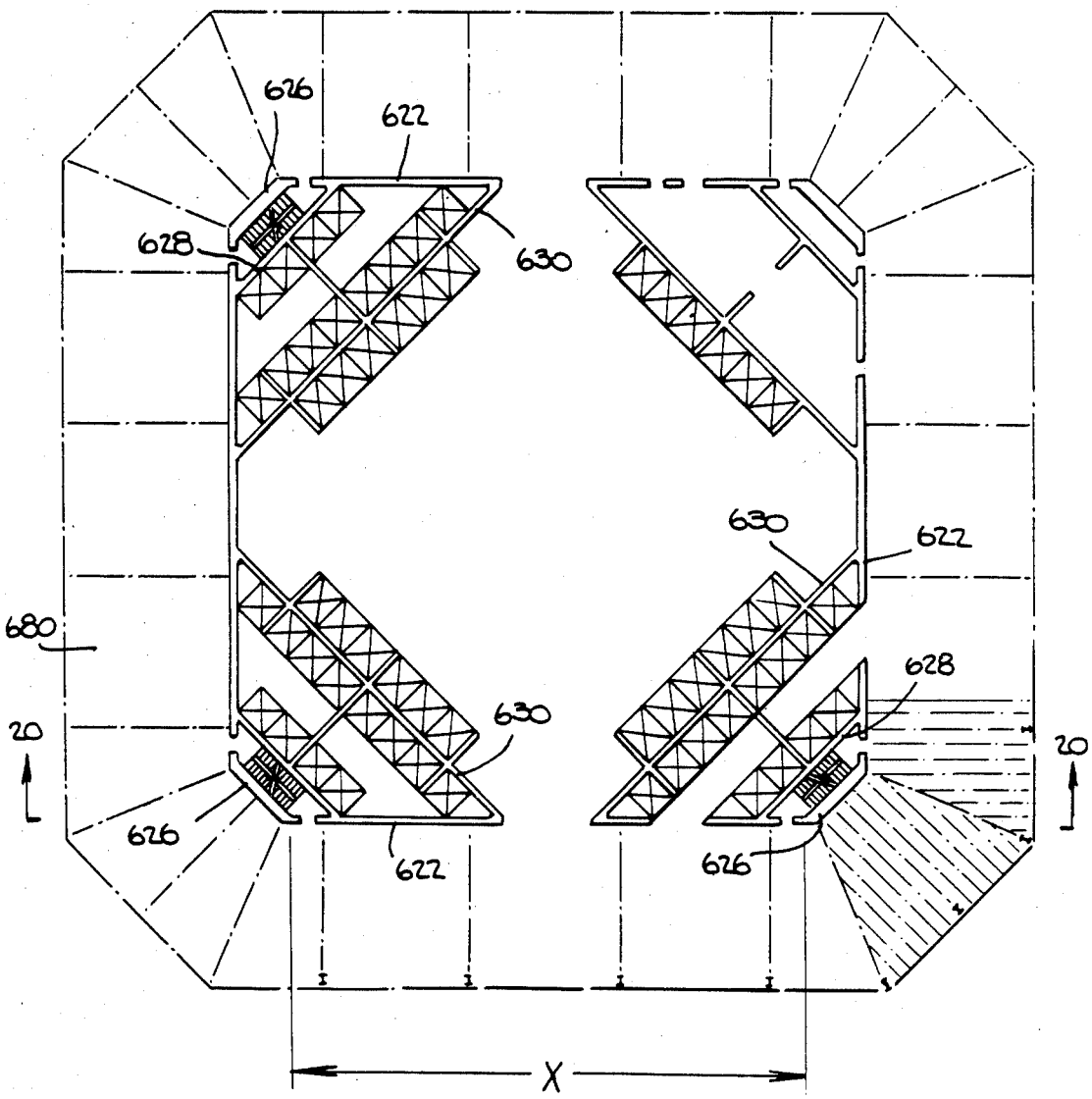
FIG. 19 is a simplified plan view of a typical upper floor in a sixth illustrative embodiment of the invention.
Figure 20:
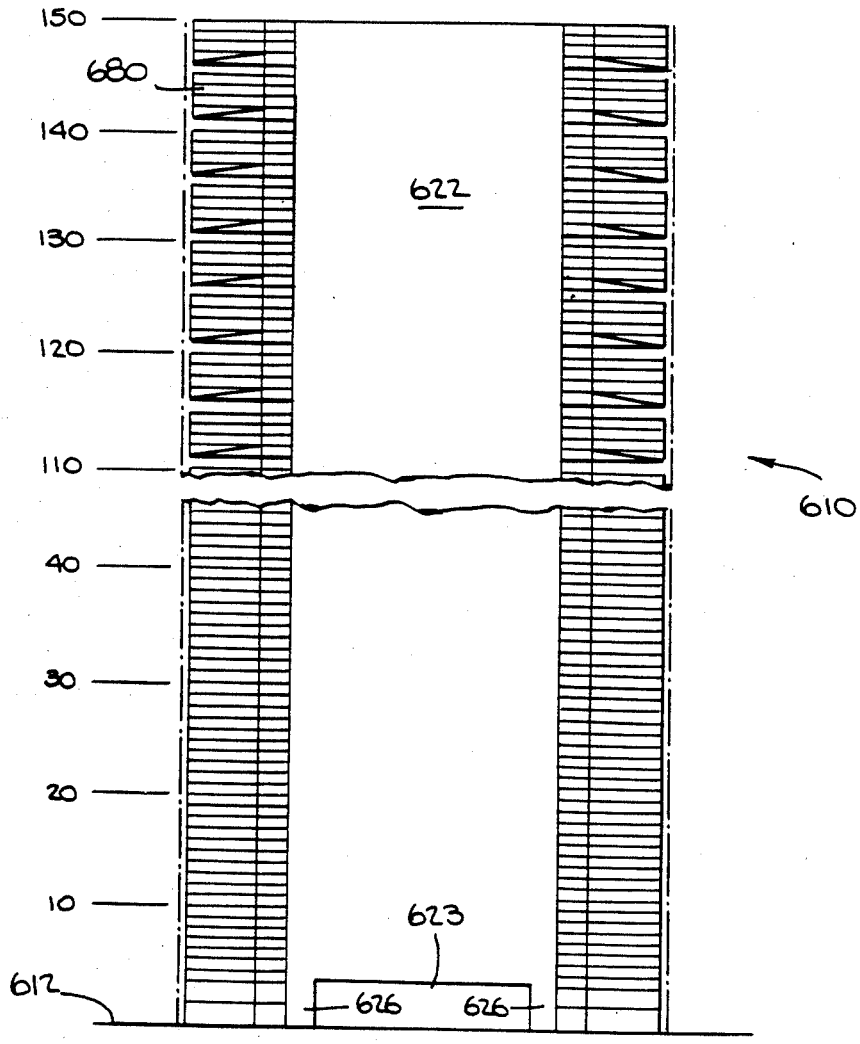
FIG. 20 is a simplified, fragmentary, sectional view taken along the line 20—20 in FIG. 19.

As FIG. 19 suggests, the series of alternating corner piers 626 and main walls 622 preferably forms, in plan view, a closed structure. Substantially all loads above at least the 75th floor are preferably carried by this closed structure. Most or all of the elevators serving the building are disposed in the area bounded by the closed structure. Exterior floors 680 extend outwardly from the closed structure, and above at least the 75th floor, these floors (and all other loads) are preferably completely supported by the closed structure. Floors 680 preferably extend continuously around the closed structure. Secondary walls (such as 628 and 630) are preferably vertically at least coextensive with the associated main walls 622. Most or all of the elevators are preferably mounted on these secondary walls.

I claim:

1. A super high-rise building for human occupation having at least 75 vertically spaced, human-occupiable stories comprising:

a foundation; and a hollow vertical prism of reinforced concrete, mounted on the foundation and being at least 75 stories high, for transmitting to the foundation at least a portion of the load of the building in a manner such that automatic lateral rigidity, stability, and strength are attained, the sides of said prism having a plurality of apertures for such purposes as allowing human movement between the inside and outside of the prism, the portion of substantially any horizontal circumference of said prism which is occupied by said apertures being less than about 25% of said horizontal circumference.

2. The building defined in claim 1 wherein said prism comprises:

at least one corner structure; and at least two substantially planar sides which, in plan view, converge toward one another adjacent said corner structure and which are integral with said corner structure.

3. The building defined in claim 2 wherein the corner structure comprises:

a vertical corner pier interconnecting the adjacent vertical edges of said two substantially planar sides.

4. The building defined in claim 3 wherein said corner pier transmits shear forces between said two substantially planar sides.

5. The building defined in claim 2 wherein the included angle between said two substantially planar sides is an acute angle.

6. The building defined in claim 5 wherein the corner structure comprises:

at least a first vertical wall interconnecting said two substantially planar sides at locations remote from the vertical edges of said two substantially planar sides.

7. The building defined in claim 6 wherein said first vertical wall transmits shear forces between said two substantially planar sides.

8. The building defined in claim 6 further comprising:

a plurality of elevator runways adjacent said first vertical wall, each of said elevator runways being at least partly defined by said first vertical wall.

9. The building defined in claim 8 wherein the elevators operating along said elevator runways are at least partly supported by said first vertical wall.

10. The building defined in claim 9 wherein said first vertical wall transmits at least a substantial portion of the weight of said elevators to said two substantially planar sides.

11. The building defined in claim 10 wherein at least some of said elevator runways are disposed in the area bounded by said first vertical wall and the portions of said two substantially planar sides which converge toward one another in the direction away from said first vertical wall.

12. The building defined in claim 11 wherein at least some of said elevator runways are disposed on the side of said first vertical wall which faces in the direction in which said two substantially planar sides diverge from one another.

13. The building defined in claim 6 wherein the corner structure further comprises:

a vertical corner pier interconnecting the adjacent vertical edges of said two substantially planar sides.

14. The building defined in claim 13 wherein said corner pier transmits shear forces between said two substantially planar sides.

15. The building defined in claim 13 wherein said corner pier comprises a second vertical wall substantially parallel to said first vertical wall.

16. The building defined in claim 15 wherein the angle subtended by said first vertical wall and the portion of one of said two substantially planar sides which extends between said first and second vertical walls is substantially equal to the angle subtended by said first vertical wall and the portion of the other of said two substantially planar sides which extends between said first and second vertical walls.

17. The building defined in claim 16 further comprising:

a plurality of elevator runways disposed in the area bounded by said two substantially planar sides and said first and second vertical walls, each of said elevator runways being at least partly defined by one of the walls bounding said area.

18. The building defined in claim 17 wherein said corner structure further comprises:

a plurality of vertically spaced, horizontal floors disposed in said area and serving as landings for at least some of the elevators operating along said elevator runways.

19. The building defined in claim 18 wherein each of said horizontal floors extends to at least one of said two substantially planar sides, said side having an aperture immediately above the intersection of said floor and said side for allowing human movement between said floor and the outside of said prism.

20. The building defined in claim 1 further comprising:

a plurality of vertically spaced, horizontal exterior foors mounted on said prism and extending radially outward from said prism, said exterior floors being supported substantially solely by said prism.

21. The building defined in claim 1 further comprising:

a plurality of vertically spaced, horizontal interior floors disposed in the interior of said prism and being supported substantially solely by said prism, the vertical spacing between vertically adjacent interior floors being at least ten times the storey-height of said building.

22. The building defined in claim 21 further comprising:

a plurality of express elevator runways in the interior of said prism, each of said express elevator runways having an express elevator travelling along it.

23. The building defined in claim 22 wherein at least some of said interior floors serve as landings for said express elevators, wherein each interior floor that serves as an express elevator landing is contiguous with at least a portion of the interior surface of said prism, and wherein said prism includes an aperture immediately above at least a portion of the junction between said interior floor and said prism for allowing human movement between said interior floor and the outside of said prism.

24. The building defined in claim 1 wherein said prism comprises:

three vertically aligned, horizontally spaced corner structures, each corner structure being located at a respective one of the vertices of a substantially equilateral horizontal triangle, and three substantially planar sides, each side being substantially parallel to a respective one of the sides of said triangle, and each side extending between the corner structures at the ends of the associated side of the triangle.

25. The buiding defined in claim 24 further comprising:

a plurality of vertically spaced, horizontal exterior floors mounted on said prism and extending radially outward from and annularly around said prism, said floors being supported substantially solely by said prism.

26. A super high-rise building for human occupation having at least 75 vertically spaced human-occupiable stories comprising:

a foundation; and first through fifth vertically oriented reinforced concrete members integrally interconnected to one another in a horizontal series, each of the first, third, and fifth members being a corner pier mounted on the foundation, and each of the second and fourth members being a wall extending between a major portion of the height of the associated corner piers for bracing the corner piers against one another and transmitting loads applied to the walls to the corner piers.

27. The building defined in claim 26 wherein the height of each of the second and fourth members is at least about 80% of the height of each of the associated corner piers.

28. The building defined in claim 26 wherein at least one of the second and fourth members has apertures for such purposes as permitting human movement horizontally through the member, the portion of substantially any horizontal axis of said member which is occupied by said apertures being less than about 33% of said horizontal axis.

29. The building defined in claim 26 wherein the series of alternating, integrally interconnected, reinforced concrete corner piers and walls continues and forms, in plan view, a closed structure, each corner pier and wall being respectively as defined above in claim 26.

30. The building defined in claim 29 wherein substantially all loads above at least the 75th floor are carried by said corner piers and walls.

31. The building defined in claim 29 further comprising:

a plurality of elevator runways disposed in the area bounded by the closed structure.

32. The building defined in claim 31 further comprising:

a plurality of floors extending outwardly from and completely supported by the closed structure.

33. The building defined in claim 32 wherein each of said floors extends continuously around the closed structure.

34. The building defined in claim 29 wherein said structure is closed by a sixth member which is a wall extending between a major portion of the height of the first and fifth members.

35. The building defined in claim 34 wherein the first, third, and fifth members are respectively located at the apexes of a horizontal equilateral triangle.

36. The building defined in claim 35 wherein each of the second, fourth, and sixth members is substantially planar.

37. The building defined in claim 36 wherein the second, fourth, and sixth members are the main walls of the structure, and wherein the portions of the main walls converging toward each corner pier are integrally interconnected by at least one vertically oriented, reinforced concrete secondary wall inside the closed structure.

38. The building defined in claim 37 wherein each secondary wall meets the two associated main walls at the same distance from the adjacent corner pier.

39. The building defined in claim 38 wherein each secondary wall is substantially planar and vertically at least coextensive with the associated main walls.

40. The building defined in claim 39 further comprising;

a plurality of elevator runways mounted on the secondary walls.

* * * * *